US005626005A

United States Patent [19]

Klingelhoefer

[11] Patent Number: 5,626,005

[45] Date of Patent: May 6, 1997

[54] APPARATUS FOR PRODUCING PACKS OF NOTES FROM BUNDLES OF NOTES OF VALUE

[75] Inventor: Hannsgeorg Klingelhoefer, Nuertingen, Germany

[73] Assignee: De La Rue Giori S.A., Lausanne, Switzerland

[21] Appl. No.: 341,484

[22] Filed: Nov. 17, 1994

[30] Foreign Application Priority Data

Dec. 3, 1993 [CH] Switzerland ..... 3618/93

[51] Int. Cl.[6] ..... B65B 35/50

[52] U.S. Cl. ..... 53/540; 53/245; 53/495; 53/535; 414/790.3

[58] Field of Search ..... 53/54, 171, 245, 53/247, 495, 520, 531, 535, 540; 414/788.3, 790.3, 791.2, 791.1

[56] References Cited

U.S. PATENT DOCUMENTS

| | | | |
|---|---|---|---|
| 3,939,621 | 2/1976 | Giori . | |
| 3,982,453 | 9/1976 | D'Amato et al. . | |
| 4,045,944 | 9/1977 | Giori | 53/535 X |
| 4,283,902 | 8/1981 | Giori | 53/520 X |
| 4,376,364 | 3/1983 | Horino et al. | 53/54 |
| 4,453,707 | 6/1984 | Kuhfuss | 53/54 X |
| 4,483,124 | 11/1984 | Ohba et al. | 53/54 |
| 4,558,557 | 12/1985 | Kuehfuss | 53/520 X |
| 4,769,975 | 9/1988 | Fava | 53/540 X |
| 4,779,401 | 10/1988 | Pedersen | 53/520 |
| 5,012,932 | 5/1991 | Omura et al. | 53/54 X |
| 5,476,361 | 12/1995 | Uno | 414/790.3 |
| 5,507,615 | 4/1996 | Uno | 414/790.3 X |

FOREIGN PATENT DOCUMENTS

| | | |
|---|---|---|
| 007693 | 4/1983 | European Pat. Off. . |
| 2262729 | 6/1993 | United Kingdom . |

*Primary Examiner*—Daniel Moon

*Attorney, Agent, or Firm*—Kane, Dalsimer, Sullivan, Kurucz, Levy, Eisele and Richard, LLP

[57] ABSTRACT

The apparatus has a distributor (11) with a straight conveying section (12), on which the N bundles of notes originating from a stack of sheets of notes are advanced one behind the other up to N predetermined bundle positions. Fitted underneath the conveying section (12), having an adjustable base (13), are N magazines in the form of vertical compartments which are located vertically underneath the bundle positions. Once all N bundle positions on the conveying section (12) are occupied by bundles, the base (13) is swung down, so that all N bundles can drop simultaneously into the N magazine compartments. After closing of the base, the next N bundles pass on the conveying section (12) into their bundle positions and, after opening of the base, can drop into the magazines as the second layer. Once packs with a predetermined number of bundles of notes lying one above the other have formed in these magazines, these packs are pushed by means of slides (16) out of the magazines (15) onto a transporting section (17), fitted next to the magazines, for the purpose of further processing.

10 Claims, 4 Drawing Sheets

FIG. 4
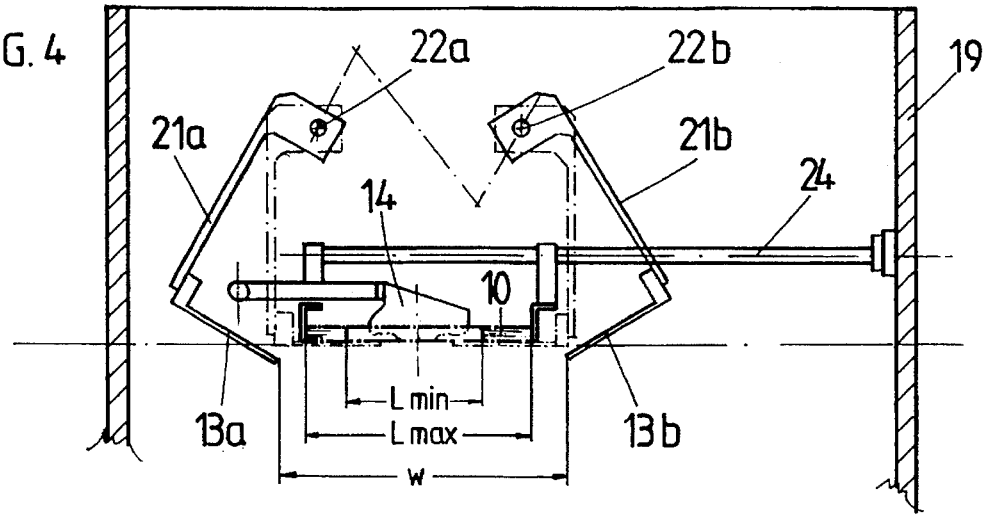
FIG. 5
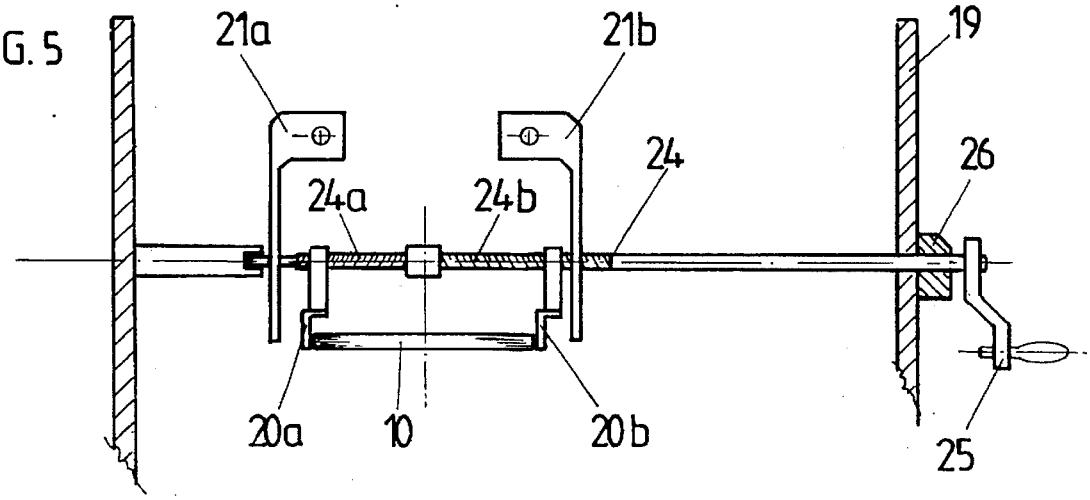
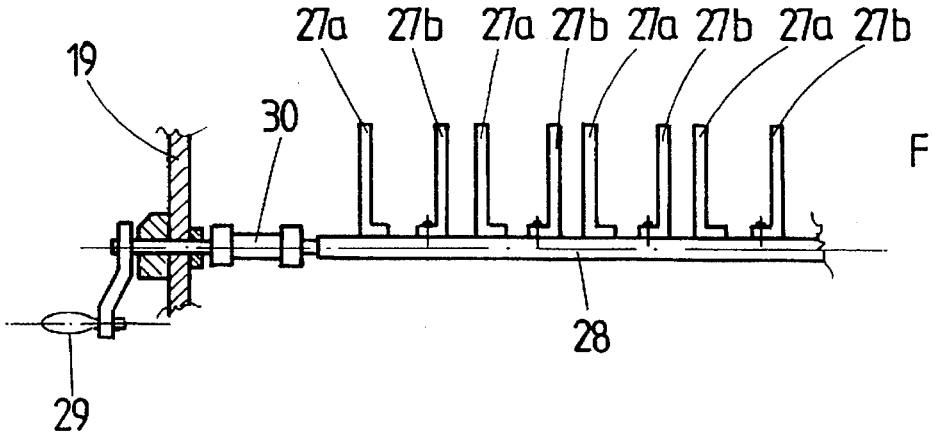
FIG. 6

APPARATUS FOR PRODUCING PACKS OF NOTES FROM BUNDLES OF NOTES OF VALUE

FIELD OF THE INVENTION

The invention relates to an apparatus for producing packs of notes of value from bundles of notes which have been cut out of piles of sheets containing notes prints.

PRIOR ART

Such an apparatus is known and is described in U.S. Pat. No. 3,939,621. In the case of this apparatus, the distributor comprises two alternately operating rotatable drums having vertical magazines which are arranged such that they are distributed around the circumference of said drums and the number N of which is equal to the number of note prints on a sheet of notes. This number of note prints of a sheet is also referred to as the number of multiple copies. The drum which is in operation at any given time rotates at an average circumferential speed which corresponds to the transporting speed of the incoming bundles of notes in such a way that successive bundles are periodically distributed individually to the N magazines. When the number of bundles intended for a pack has stacked up in the magazines, the following bundles are fed to the second drum, while the full magazines of the first drum are successively emptied; the packs are pushed one after the other onto a transporting section and fed to a packing station.

This sorting of the bundles of notes is required for the following reason: the numbering of the sheets of notes, on which N note prints are printed in matrix form in rows and columns, is generally performed in such a way that all the note positions on one sheet receive the same numbering in the last three positions of the number and the same note positions of successive sheets are consecutively numbered, while the numbers of the note positions on one and the same sheet differ in the higher positions, for example in the thousands or ten thousands, or by different series designations. Downstream of the numbering machine, generally stacks with 100 sheets in each case are formed, so that after the cutting of one stack N bundles with 100 notes of value in each case are obtained. Within a bundle, the notes are consecutively numbered, but the sequence of numbers within a bundle is not the continuation of the sequence of numbers in the preceding bundle. If, for example, the number of note prints on a sheet is N=20, the note positions being arranged in five rows and four columns, then for the production of packs with 10 bundles in each case, that is to say with 1000 notes, the first, the twenty-first, the forty-first, etc. then the second, the twenty-second, the forty-second, etc., must be gathered together in order that packs of notes with 1000 notes can be formed in the correct sequence of numbers of a series of a thousand.

The construction and operation of the distributor mentioned at the beginning, operating with two rotatable drums, for sorting the bundles of notes are relatively complicated. Also, once they have been formed, the packs of notes must be individually removed one after the other from the magazines of the drum.

SUMMARY OF THE INVENTION

The present invention is based on the object of providing a distributor for sorting the bundles of notes which is of a simple construction, has only a few moving parts and allows a simultaneous removal of all N packs from the magazines, so that it can be operated at a high operating speed.

This apparatus achieves the effect that in each case one layer of N bundles of notes falls simultaneously into the N magazines and that, after formation of the finished packs of notes, these are pushed out simultaneously from all the magazines. In addition, the distributor can be adapted in a simple way to various numbers N of multiple copies by correspondingly lengthening or shortening the conveying section and increasing or reducing the number of magazines located there under. In this case, modular units comprising a particular number of magazines arranged next to one another, for example ten magazines, are expediently used with the associated conveying section. Thus, for example, maximum numbers of multiple copies of 40, 50 and 60 can be processed. Of course, a distributor intended for N multiple copies can be readily used also for smaller numbers of multiple copies without complications arising.

Usually, packs of notes of ten bundles with 100 notes each, that is to say packs with 1000 consecutively numbered notes, are formed.

Expedient developments of the invention emerge from the dependent claims.

The invention is explained in more detail by an exemplary embodiment with reference to the drawing.

BRIEF DESCRIPTION OF THE DRAWINGS

FIG. 4 shows a partial view of the same section with opened base, FIG. 5 shows a view of the adjustable side walls of the conveying section for guiding the bundles of notes, FIG. 6 shows a diagrammatic partial view of the magazines, without slides, in the direction of the arrow F6 according to FIG. 2

DESCRIPTION OF THE PREFERRED EMBODIMENT(S)

Figures 1, 2:
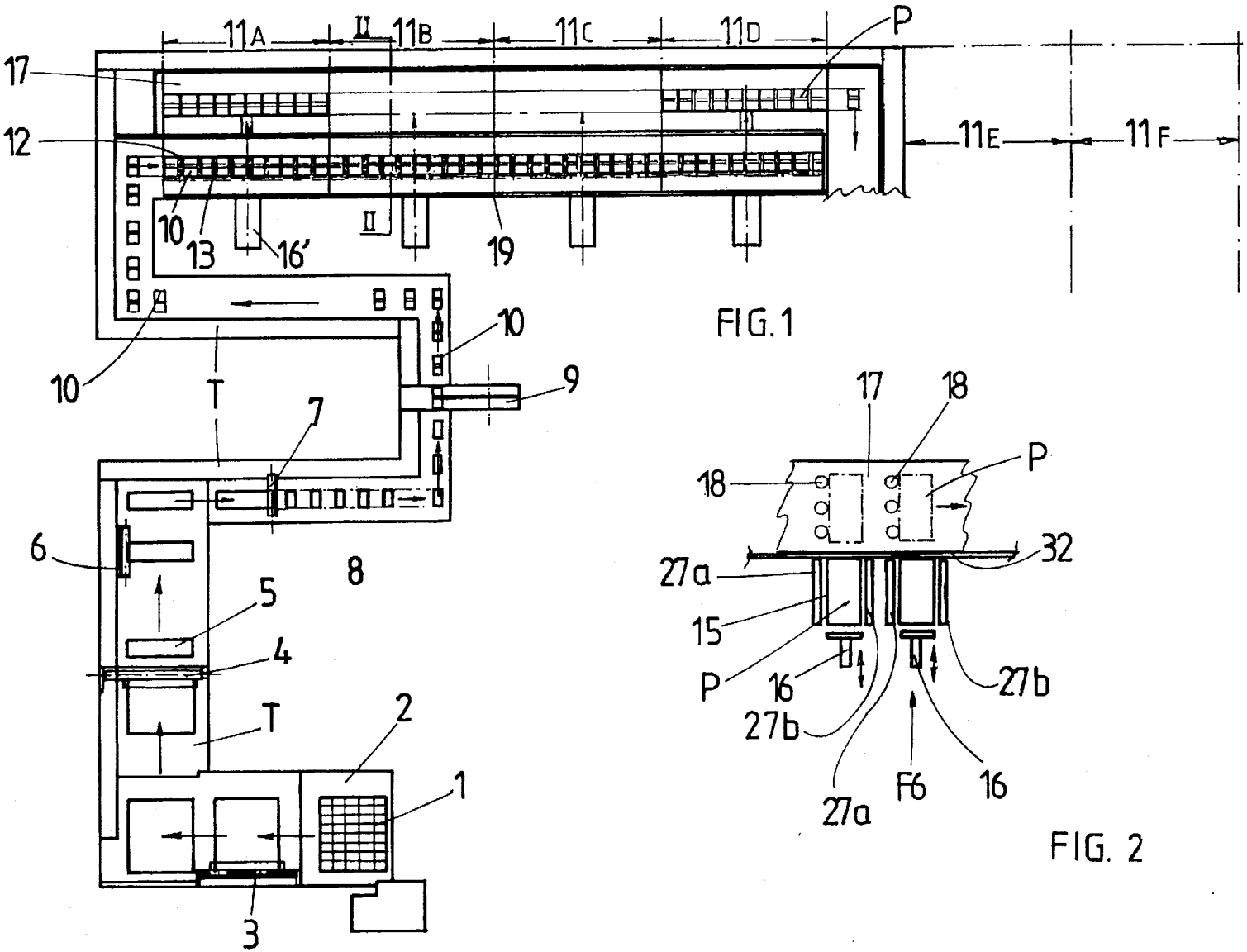
FIG. 1 shows a diagrammatic plan view of an installation for processing numbered sheets of notes to form packs of notes with the aid of a distributor according to the invention.
FIG. 2 shows a diagrammatic partial view of the distributor in plan view of two neighboring magazines.

The installation according to FIG. 1 is intended for the processing of sheets of notes which have already numbered note prints and are passed in the form of stacks 1 with 100 sheets each onto the feeding device 2 of a cutting machine. In the example considered, each sheet has 40 note prints or multiple copies, which are arranged in matrix form in five columns and eight rows, as diagrammatically indicated for the top sheet of the stack 1. The note prints lying one above the other in the stack of sheets belong in each case to a certain numerical series and are consecutively numbered within this series.

The stacks of sheets 1 are fed to the first cutting unit 3 for edge trimming and then pass in the direction of the arrows by means of a transporting system T, after changing the transporting direction through 90°, to a second cutting unit 4, in which the stack of sheets is cut into stacks of strips 5. Eight successive stacks of strips in each case, each with five note prints per strip, originate from the same stack of sheets 1.

Figure 3:
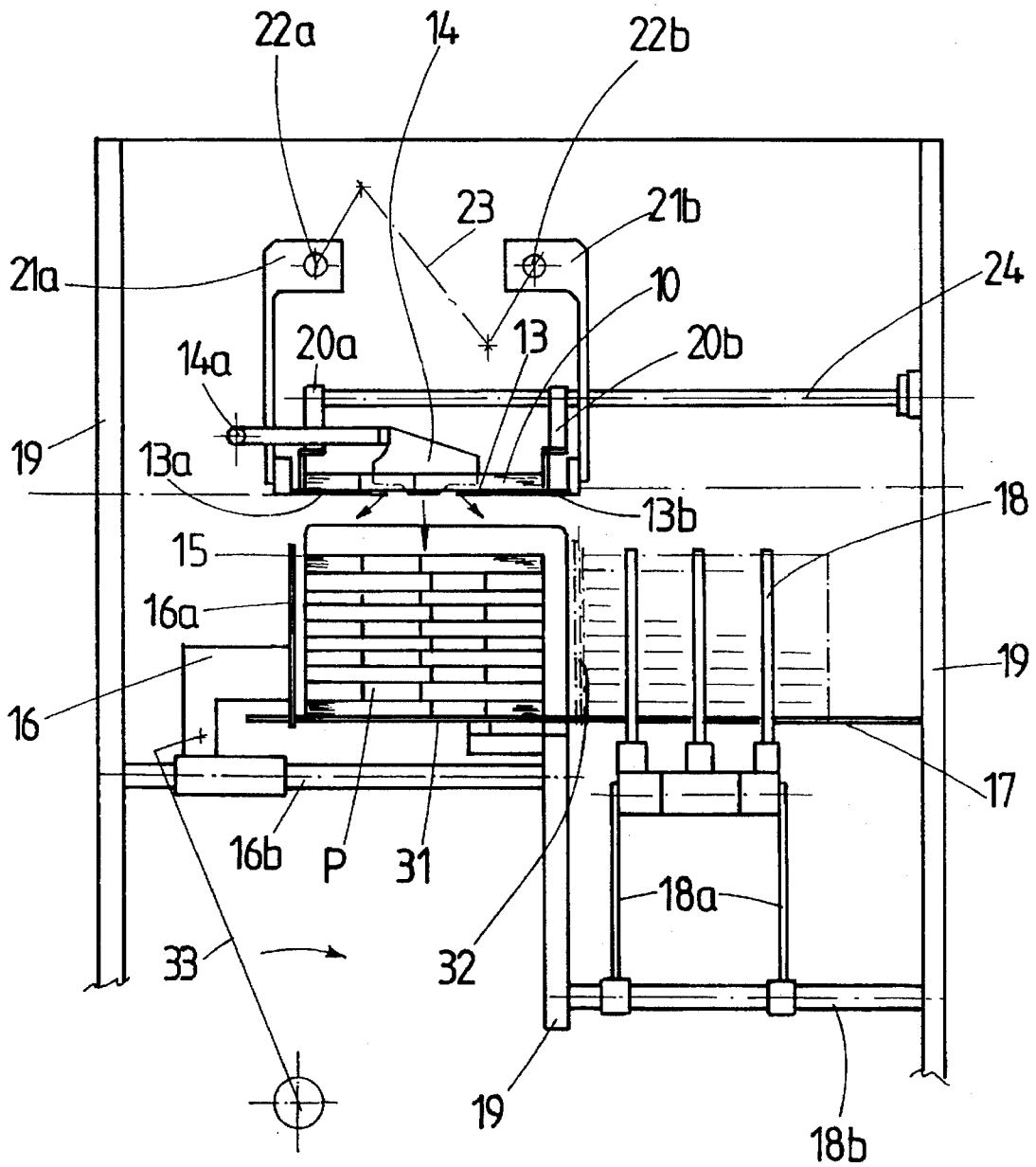
FIG. 3 shows a section along II—II according to FIG. 1, the base of the conveying section being closed.

The stacks of strips 5 are transported to a third cutting unit 6, at which a further edge trimming is performed, and then pass, after renewed changing of the transporting direction through 90°, in the direction of the arrow to a fourth cutting unit 7, in which the strips are cut into bundles 8. Each bundle 8 contains 100 notes cut to format with consecutive numbering. These bundles 8 then pass on the transporting system T to a banderoling station 9, where they are provided with banderoles, and the banderoled bundles 10 are fed in the direction of the arrows to the distributor 11. To be able later to stack the banderoled bundles 10 correctly into packs, the banderoles are not applied centrally, but laterally displaced, and downstream of the banderoling station 9 every second bundle is turned through 180° (not shown in FIG. 1). In this way, the banderoles of neighboring bundles lie offset next to one another in the packs, as indicated in FIG. 3.

For reasons of the spatial construction of the installation, in the example being considered the transporting direction of the banderoled bundles 10 is changed three times through 90° in the transporting system T between the banderoling station 9 and the entrance of the distributor 11.

In the example being considered, the distributor 11 is composed of identically constructed modular units 11A, 11B, 11C and 11D, which are fitted one behind the other in the longitudinal direction. Each modular unit is set up for the production of ten packs of bundles, so that a number of packs corresponding to the number of note prints per sheet of notes, that is in the example being considered 40 packs, can thus be formed simultaneously. All the components of a modular unit are fitted in a rack 19 and substantially comprise a straight conveying section 12 with a base 13, a system of drivers 14 for the advancement of the bundles (FIG. 3), ten magazines 15 which are arranged one behind the other underneath the base 13 and have vertical compartments, a transporting section 17 for the transporting away of the finished packs P with the aid of drivers 18, and ten slides 16, which are assigned to the ten magazines 15, form the removal device (FIGS. 2 and 3) and can be jointly actuated by a control unit 16' each (FIG. 1).

Figure 7:
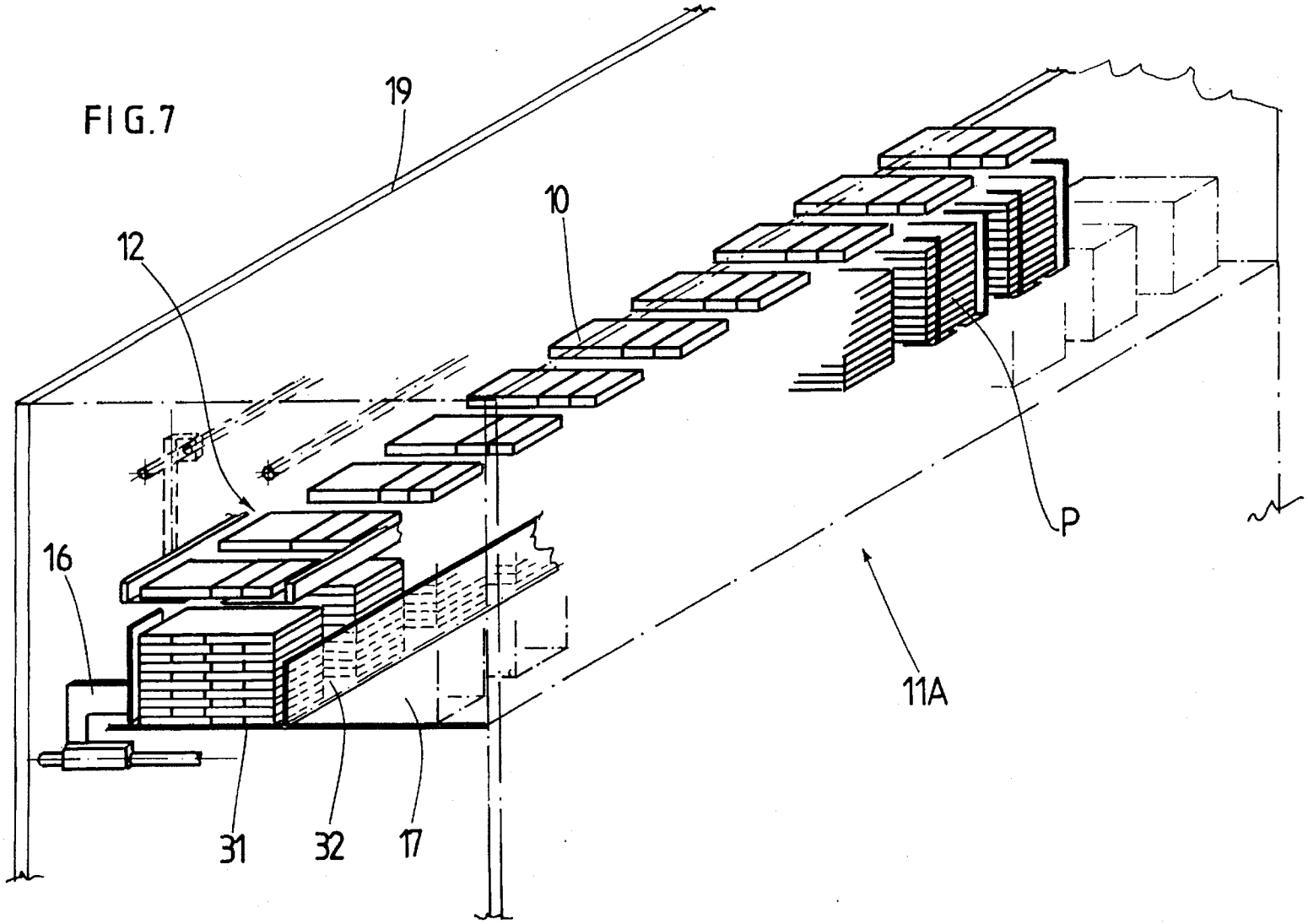
FIG. 7 shows a diagrammatic perspective view of a modular unit.

FIG. 7 shows a diagrammatic perspective view of a modular unit.

On each conveying section 12 there are provided ten bundle positions, which are arranged one behind the other with the predetermined spacing, are aligned with the magazines 15 and are located vertically above these magazines. The system of drivers 14 is installed above the base 13 and set up to take over the banderoled bundles 10 arriving at the distributor 11 on the transporting system T and to advance them cycle by cycle, to be precise until all forty bundle positions of the distributor 11 above the magazines are occupied. For this purpose, the drivers 14 operate in a known way, such that during an advancing cycle they advance the bundles simultaneously by a distance which corresponds to the spacing between two successive bundle positions, then are moved upward out of the path of the bundles, are pushed back by the distance of a cycle and are then lowered behind the respectively following bundles, which during the following cycle are advanced to the next bundle position. In the diagrammatic representation according to FIG. 3, each driver 14 can be tilted upward about a shaft 14*a*, which is arranged laterally on the conveying section 12 and parallel to the conveying section, and can be displaced back and forth by longitudinal movement of the shaft. By this cyclical advancement, the same, reproducible bundle positions are always reached, which would not be possible for example with a chain transporting means.

The bases 13 of the distributor, which normally cover the magazines 15 at the top and form a continuous planar underlay during advancement of the bundles, are adjustable for the release of the magazines by means of an actuating mechanism, so that the bundles taking up their bundle position can drop downward into the relevant magazines. In the example being considered, the conveying section 12 of each modular unit is constructed using an articulated table, in which the base 13, formed by the table top, comprises two halves 13*a*, 13*b*, which can be symmetrically opened up downward in the direction of the arrows. The two base halves 13*a*, 13*b* are fastened on vertical arms 21*a*, 21*b*, the upper ends of which are articulated on horizontal spindles 22*a*, 22*b* oriented parallel to the conveying section.

When the actuating mechanism is activated, therefore both arms 21*a* and 21*b* with the base halves 13*a* and 13*b* are swiveled outward oppositely with respect to each other, in order to expose the upper magazine opening. This opening position is represented in FIG. 4. Both arms 21*a*, 21*b* and both spindles 22*a*, 22*b* are respectively connected to each other, as indicated in FIGS. 3 and 4, by a linkage 23, which ensures a synchronous, parallel opening of the two base halves 13*a*, 13*b*.

As shown in FIG. 3, a gap is provided between the inner ends of the two base halves 13*a*, 13*b*, in order that the drivers 14 can enter into this gap during transporting of the bundles and can consequently take up each bundle 10 over the entire thickness.

Mounted in the rack 19 above the conveying section 12 there is a threaded spindle 24 (FIG. 5), which is oriented transversely to the transporting direction and has on either side of the center of the bases 13 a right-hand thread 24*a* and a left-hand thread 24*b*, respectively. Seated on these threads are side walls 20*a* and 20*b*, which are oriented parallel to the transporting direction, serve for correct lateral guidance of the bundles during advancement and can be adapted to the dimension of the bundles transversely to the conveying section, that is to say in the example being considered to the length of the bundles. This is performed by turning the threaded spindle 24 by means of a central adjusting means, in the example being considered a hand crank 25. When doing so, a counting unit 26 indicates the bundle length set.

In FIG. 4, the minimum note length L min and the maximum note length L max which can be processed are indicated by way of example. The opening width W, which is adapted to the maximum note length or bundle length, is always constant, so that the opening stroke is always of the same size, irrespective of the note format.

Each magazine 15 is formed by a rectangular sheet-metal compartment having a base plate 31 and each having two parallel side walls 27*a* and 27*b*, which form the lateral limitations of the magazine directed transversely to the conveying section 12. The side walls 27*a* at the rear in the transporting direction are fitted fixedly on the rack 19 and the other, front side walls 27*b* are adjustably fitted. The arrangement is set up in such a way that all front walls 27*b* of the magazines 15 of a module are fastened on a common, longitudinally displaceable bar 28 (FIG. 6), so that they can be adjusted together. This adjustability serves on the one hand for the adaptation of the magazine width to the bundle width and on the other hand for the temporary enlargement of the magazine width when a bundle drops into the magazine.

In order to adapt the magazine width to the bundle width, in the direction of the double-headed arrow F1 according to FIG. 6, there is provided a central adjusting means with a hand crank 29, which by means of a thread allows the bar 28 to be displaced, so that all the front side walls 27*b* are correspondingly set with respect to the fixed rear limitation of the magazines 15, that is to say the fixed rear walls 27*a*. These fixed walls 27*a* lie vertically underneath the end at the rear in the transporting direction of the relevant bundle position on the conveying section 12, so that the dropping bundle always bears with its rear edge virtually up against the fixed wall 27*b*, irrespective of the note format. In this way, when there is a format change of the notes, the mentioned forty bundle positions on the conveying section 12 need not be changed, and it is possible to operate always with the same constant advancement of the drivers 14, irrespective of the format of the bundles. A counting unit 29 provided at the central format adjusting means (FIG. 6) shows the magazine width set.

In addition, the bar 28, set to bundle width, is adjustable with the front side walls 27*b* by a small distance of, for example, about 10 mm in the direction of the double-headed arrow F2 by means of an adjusting element in the form of a pneumatic cylinder 30, which according to FIG. 6 is arranged between the central adjusting means with the hand crank 29 and the bar 28; the purpose of this adjustment is explained later in the functional description.

As shown in FIGS. 2 and 3, each magazine 15 is bounded parallel to the conveying section 12 on the side facing away from the transporting section 17 by the slide plate 16*a* of the relevant slide 16 and on the opposite side by a continuous, downwardly lowerable wall 32, which extends over the entire length of a modular unit. The slides 16 are displaceable on a shaft 16*b*, which is oriented transversely to the conveying section, by means of an only diagrammatically indicated adjusting element 33, and their retracted position of rest can be adapted to the dimension of the bundles. The height of the magazines 15 is dimensioned such that packs with the desired number of bundles lying one above the other can be stacked therein, usually that is, as in the example being considered, ten bundles each.

On the side facing away from the slides 16, the transporting section 17, which runs parallel to the conveying section 12, lies directly next to the magazines 15 and at the same height as the magazine bases 13. The advancing system assigned to this transporting section 17 has drivers 18 in the form of sliding bars which are fitted on supports 18*a*, which for their part are seated on a swivelling spindle 18*b*. This advancing system is set up for a cycle-by-cycle transporting of the packs P on the transporting section 17, the drivers 18 dipping below the plane of the transporting section 17 during the return stroke.

The distributor 11 operates as follows: as soon as N successive banderoled bundles 10, that is in the example being considered forty bundles, have been advanced up to their intended bundle positions on the bases 13, that is to say when the entire distributor is occupied by the forty bundles 10, the swinging down of the bases 13, of a two-part design, is performed by means of an automatic control device, so that all forty bundles drop simultaneously into the magazines 15. In order to ensure sufficient free space for the dropping of the bundles, the width of the magazines 15, set to bundle format, is temporarily enlarged by approximately 10 mm, by the adjustable walls 27*b* being displaced with the aid of the pneumatic cylinder 30, before the swinging down of the bases. Immediately after the dropping of the bundles, the bases 13 are closed again, so that the cycle-by-cycle advancement of the bundles coming from the transporting system T on the conveying section 12 is not interrupted. In addition, the magazine width is adapted again to the bundle format by pushing back the walls 27*b*, so that the bundles are aligned in the magazine and correct packs are formed.

Once the next group of N bundles 10 has reached the distributor 11 and all 40 bundle positions are occupied again, the bases 13 are swung up once again, so that the second layer of forty bundles can drop into the magazines. This operation is repeated ten times, until in each magazine ten bundles have been stacked into a complete pack. Then, the wall 32 is lowered below the plane of the magazine bases and the slides 16 are jointly advanced by means of the control units 16', so that all forty packs P pass transversely to the conveying section 12 onto the transporting section 17 simultaneously. Then, the walls 32 are pushed up. On the transporting section 17, the packs are transported away by means of the drivers 18 and then fed for further processing to a known packing station, while the following group of forty bundles passes onto the distributor 11. In the upper position, the wall 32 serves for the lateral guidance of the packs during transporting.

The cycled advancement of the packs ensures that the same reproducible pack position is always reached. An independent drive is preferably provided for transporting the packs, so that the emptying of the apparatus can be carried out asynchronously with respect to the operating speed of the preceding operations, in particular quicker than these, in order that the transporting section 17 is cleared in good time before the next row of packs is pushed out by the slides 16.

The control for opening the bases 13 is advantageously performed by means of a photocell, which is arranged at the forwardmost bundle position, which the first bundle of a group of N bundles assumes on the conveying section when the Nth bundle has reached the rearmost bundle position of the conveying section.

If sheets of notes with fifty or sixty note prints or multiple copies are to be processed, it is sufficient to lengthen the distributor 11 by a further modular unit 11E or by two modular units 11E and 11F. Each modular unit has all the components required for the functions of transporting the bundles and packs, as represented in FIG. 3. The modular units required for a complete apparatus are simply connected mechanically to one another by couplings.

The invention is not restricted to the exemplary embodiment described, but includes manifold variants with regard to the design of the individual parts.

I claim:

1. An apparatus for producing packs (P) of notes of value, each of said packs (P) comprising a number Z of bundles of notes stacked one onto the other, each of said Z bundles of notes containing a number H of consecutively numbered notes of value, said Z bundles of notes being formed by cutting Z successive stacks of sheets of notes, each of said Z successive stacks containing H successive sheets of notes, each of said H successive sheets of notes containing a number N of individual note prints, said N individual note prints being disposed in rows and columns on each of said H successive sheets, each individual note print placed at a given position in said rows and columns being consecutively numbered within said H successive sheets of notes;

a group of N bundles (10) of notes originating from each of said stacks of H successive sheets (1) being moved spaced apart one behind the other on a transporting system (T);

said groups of N bundles (10) of notes each originating from successive stacks of sheets following one another;

the apparatus having a distributor (11) for the periodic depositing of said N bundles (10) of notes of value in N different magazines (15), each of said N magazines (15) forming one of said packs of notes with said Z bundles (10) of notes, each of said pack of notes containing Z×H consecutively numbered notes of value;

and having a removal device (16) for displacing the packs (P) out of said magazines (15) onto a transporting section (17) for further processing;

wherein said distributor (11) has a straight conveying section (12) adjoining said transporting system (T) and having at least N different bundle positions and a base (13) which can be actuated by an automatically controllable actuating mechanism and serves as a rest for said bundles (10);

a system of drivers (14) installed above said base (13) for the advancement of said bundles (10);

said N magazines (15) being underneath said base (13) and aligned with said bundle positions, said magazines (15) having the shape of compartments, each with an upper opening;

said transporting section (17) running next to said magazines (15) and parallel to said conveying section (12), said actuating mechanism being set up for opening said base (13) to expose said upper opening of said magazines (15) when all said N bundle positions are occupied by bundles (10), so that said N bundles (10) drop into said N magazines (15), and for subsequently closing said base (13) again before the first bundle of a following group of N bundles arrives;

and wherein said removal device (16) is set up for displacing said packs (P) simultaneously out of said N magazines (15) onto said transporting section (17) once N complete packs (P) with Z bundles (10) of notes each have been formed.

2. The apparatus as claimed in claim 1, wherein the base (13) comprises two halves (13*a*, 13*b*) which can be swung downward.

3. The apparatus as claimed in claim 1, wherein it is constructed from modular units (11A, 11B, 11C, 11D, 11E) which can be fitted one against the other, each of which is designed for the simultaneous processing of an equal number of bundles and in each case comprises a correspondingly long distributor portion and an assigned portion of the transporting section.

4. The apparatus as claimed in claim 1, wherein it is designed for producing packs from a preselectable number of bundles, preferably 10 bundles with 100 notes of value each.

5. The apparatus as claimed in claim 1, wherein the advancement of the bundles by means of the drivers (14) is designed as a cycled advancement.

6. The apparatus as claimed in claim 1, wherein the conveying section (12) has for lateral guidance of the bundles side walls (20*a*, 20*b*) which can be set by a central adjusting means (24, 25) for adaptation to a bundle format.

7. The apparatus as claimed in claim 1, wherein each magazine (15) is bounded transversely to a transporting direction of the bundles (10) by a first side wall (27*a*) fitted fixedly on the apparatus (19) and a second side wall (27*b*) which is adjustable with respect to the first side wall and wherein all of the adjustable second side walls (27*b*) can be adjusted together by a central adjusting means (28, 29) for the purpose of adaptation of the magazine dimension to a bundle format.

8. The apparatus as claimed in claim 7, wherein the adjustable second side walls (27*b*) can additionally be adjusted before the dropping of the bundles with an automatically actuable adjusting element (30) simultaneously out of the position adapted to the bundle format into a position enlarging the magazine dimension and subsequently back again into the position adapted to the bundle format.

9. The apparatus as claimed in claim 1, wherein the transporting section (17) for the packs (P) is equipped with a cycle-by-cycle operating advancing system (18).

10. The apparatus as claimed in claim 9, wherein the cycle-by-cycle operating advancing system (18) for the packs (P) has an independent drive.

* * * * *